US010161599B2

(12) United States Patent
Kubis et al.

(10) Patent No.: US 10,161,599 B2
(45) Date of Patent: Dec. 25, 2018

(54) RESONANCE MOVEMENT DAMPENING SYSTEM FOR AN AUTOMATED LUMINAIRE

(71) Applicant: Robe Lighting s.r.o., Roznov pod Radhostem (CZ)

(72) Inventors: Frantisek Kubis, Roznov pod Radhostem (CZ); Josef Valchar, Prostredni Becva (CZ); Pavel Jurik, Prostredni Becva (CZ)

(73) Assignee: Robe Lighting s.r.o., Roznov pod Radhostem (CZ)

( * ) Notice: Subject to any disclaimer, the term of this patent is extended or adjusted under 35 U.S.C. 154(b) by 67 days.

(21) Appl. No.: 15/125,162

(22) PCT Filed: Mar. 10, 2015

(86) PCT No.: PCT/US2015/019746
§ 371 (c)(1),
(2) Date: Sep. 10, 2016

(87) PCT Pub. No.: WO2015/138481
PCT Pub. Date: Sep. 17, 2015

(65) Prior Publication Data

US 2017/0016595 A1 Jan. 19, 2017

Related U.S. Application Data

(60) Provisional application No. 61/950,399, filed on Mar. 10, 2014.

(51) Int. Cl.
*F21V 14/02* (2006.01)
*H05B 37/02* (2006.01)

(52) U.S. Cl.
CPC ..... *F21V 14/02* (2013.01); *H05B 37/029* (2013.01)

(58) Field of Classification Search
CPC ..... F21V 14/02; H05B 37/029
See application file for complete search history.

(56) References Cited

U.S. PATENT DOCUMENTS 5,188,452 A 2/1993 Ryan
5,227,931 A 7/1993 Misumi
(Continued)

FOREIGN PATENT DOCUMENTS

CN 2062838 U 9/1990
CN 2589551 Y 12/2003
(Continued)

OTHER PUBLICATIONS

PCT International Search Report; Application No. PCT/US2015/019746; dated Dec. 1, 2015; 4 pages.
(Continued)

*Primary Examiner* — Muhammad S Islam
(74) *Attorney, Agent, or Firm* — Conley Rose, P.C.; Grant Rodolph; Brooks W Taylor

(57) ABSTRACT

Described is a motion control system for drive motors in automated multiparameter luminaires that employs jerk (3rd derivative of position as a function of time) to offset the resonance characteristics of the motor as loaded by the components in the luminaire, so as to correct and mitigate movement caused by external vibration sources.

19 Claims, 4 Drawing Sheets

(56) References Cited

U.S. PATENT DOCUMENTS

| | | | | |
|---|---|---|---|---|
| 5,374,883 | A * | 12/1994 | Morser | G05B 19/404 318/605 |
| 5,406,176 | A | 4/1995 | Sugden | |
| 5,764,018 | A | 6/1998 | Liepe et al. | |
| 5,955,855 | A | 9/1999 | Van Ochten et al. | |
| 6,580,244 | B2 | 6/2003 | Tanaka et al. | |
| 2001/0007527 | A1 | 7/2001 | Lammers et al. | |
| 2004/0135534 | A1 | 7/2004 | Cullen | |
| 2009/0231854 | A1 | 9/2009 | Junk | |
| 2009/0231864 | A1* | 9/2009 | Polasek | G05B 19/404 362/418 |
| 2011/0063847 | A1 | 3/2011 | Quadri et al. | |
| 2011/0249442 | A1 | 10/2011 | Jurik et al. | |
| 2013/0162172 | A1* | 6/2013 | Baaijens | H05B 33/0863 315/292 |
| 2014/0025195 | A1 | 1/2014 | Ahmadpour | |
| 2014/0301071 | A1 | 10/2014 | Jorgensen et al. | |
| 2015/0230320 | A1* | 8/2015 | Gritti | H05B 37/0245 340/12.3 |
| 2015/0308663 | A1 | 10/2015 | Jurik et al. | |
| 2016/0290597 | A1 | 10/2016 | Jurik et al. | |
| 2016/0299489 | A1 | 10/2016 | Jurik et al. | |
| 2018/0129027 | A1 | 5/2018 | Jurik et al. | |

FOREIGN PATENT DOCUMENTS

| | | | |
|---|---|---|---|
| CN | 1854598 | A | 11/2006 |
| CN | 102959326 | A | 3/2013 |
| CN | 103270437 | A | 8/2013 |
| EP | 1710495 | A1 | 10/2006 |
| EP | 2590044 | A1 | 5/2013 |
| EP | 2770251 | A1 | 8/2014 |
| JP | 2006162878 | A | 6/2006 |
| JP | 2012084298 | A | 4/2012 |
| WO | 03079532 | A2 | 9/2003 |
| WO | 2012004760 | A1 | 1/2012 |
| WO | 2012083957 | A1 | 6/2012 |
| WO | 2014031641 | A2 | 2/2014 |

OTHER PUBLICATIONS

PCT Written Opinion of the International Searching Authority; Application No. PCT/US2015/019746; dated Dec. 1, 2015; 8 pages.
Office Action dated Oct. 5, 2017; U.S. Appl. No. 15/026,889, filed Apr. 1, 2016; 12 pages.
Final Office Action dated Jun. 11, 2018; U.S. Appl. No. 15/026,889, filed Apr. 1, 2016; 36 pages.
Office Action dated May 24, 2018; U.S. Appl. No. 15/516,397, filed Apr. 1, 2017; 16 pages.
PCT International Search Report; Application No. PCT/US2014/058682; dated Jul. 20, 2015; 5 pages.
PCT Written Opinion of the International Searching Authority; Application No. PCT/US2014/058682; dated Jul. 20, 2015; 6 pages.
PCT International Search Report; Application No. PCT/US2014/058688; dated Mar. 12, 2015; 3 pages.
PCT Written Opinion of the International Searching Authority; Application No. PCT/US2014/058688; dated Mar. 12, 2015; 6 pages.
PCT International Search Report; Application No. PCT/US2015/053557; dated Mar. 15, 2016; 5 pages.
PCT Written Opinion of the International Searching Authority; Application No. PCT/2015/053557; dated Mar. 15, 2016; 7 pages.
Chinese Office Action; Application No. 201480065736.5; dated May 28, 2018; 13 pages.
European Examination Report; Application No. 14824174.8; dated Jan. 5, 2018; 5 pages.
European Examination Report; Application No. 15825876.4; dated May 29, 2018; 5 pages.
Chinese Office Action; Application No. 201480065732.7; dated Jun. 5, 2018; 11 pages.
Advisory Action dated Aug. 23, 2018; U.S. Appl. No. 15/026,889, filed Apr. 1, 2016; 3 pages.
Notice of Allowance dated Oct. 3, 2018; U.S. Appl. No. 15/516,397, filed Apr. 1, 2017; 14 pages.

* cited by examiner

RESONANCE MOVEMENT DAMPENING SYSTEM FOR AN AUTOMATED LUMINAIRE

RELATED APPLICATION

This application claims priority of U.S. Provisional Application No. 61/950,399 filed Mar. 10, 2014, and International Application No PCT/US2015/019746 filed Mar. 10, 2015.

TECHNICAL FIELD OF THE INVENTION

The present invention generally relates to a method for controlling the movement resonances and vibrations in an automated luminaire, specifically to a method relating to predicting and applying opposing forces in order to dampen such resonances.

BACKGROUND OF THE INVENTION

Luminaires with automated and remotely controllable functionality are well known in the entertainment and architectural lighting markets. Such products are commonly used in theatres, television studios, concerts, theme parks, night clubs and other venues. A typical product will typically provide control over the pan and tilt functions of the luminaire allowing the operator to control the direction the luminaire is pointing and thus the position of the light beam on the stage or in the studio. This position control is often done via control of the luminaire's position in two orthogonal rotational axes, usually referred to as pan and tilt. Many products provide control over other parameters such as the intensity, color, focus, beam size, beam shape and beam pattern. The motors used to drive these systems are often stepper motors which are driven from a motor control system within the luminaire. The connected systems, particularly those for the pan and tilt movement, may be connected through drive belts or other such gear systems and, because of the flexibility of the drive, and the mass of the driven load, exhibit significant resonances of the movement which result in bounce or overshoot.

Considering as an example, the use of such a product in a theatre, it is common for an automated luminaire to be situated at some considerable distance from the stage, perhaps 50 feet or more. At such a distance, very small positional movements of the luminaire will produce a correspondingly large movement of the light beam where it impinges on the stage. In the example given of a 50 foot throw, a displacement of 1 inch on the stage would be caused by a change in angle of either of the pan and tilt axes of the light of only 0.1 degree. If we consider that a positional accuracy of the light on the stage of less than 1 inch is desirable, we can see that a very high degree of rotational accuracy is desirable for the pan and tilt systems.

FIG. 1 illustrates a typical multiparameter automated luminaire system 10. These systems typically include a plurality of multiparameter automated luminaires 12 which typically each contain on-board a light source (not shown), light modulation devices, electric motors coupled to mechanical drive systems and control electronics (not shown). In addition to being connected to mains power either directly or through a power distribution system (not shown), each luminaire is connected is series or in parallel to data link 14 to one or more control desks 15. The luminaire system 10 is typically controlled by an operator through the control desk 15.

FIG. 2 illustrates different levels of control 60 of a parameter of the light emitted from a luminaire. In this example the levels are illustrated for one parameter: pan (typically movement in a horizontal plane). The first level of control 62 is the user who decides what he wants and inputs information into the control desk through a typical computer human user interface(s) 64. The control desk hardware and software then processes the information 66 and sends a control signal to the luminaire via the data link 14. The control signal is received and recognized by the luminaire's on-board electronics 68. The onboard electronics typically includes a motor driver 70 for the pan motor (not shown). The motor driver 30 converts a control signal into electrical signals which drive the movement of the pan motor (not shown). The pan motor is part of the pan mechanical drive 32. When the motor moves, it drives the mechanical drive 32 to drive the mechanical components which cause a light beam emanating from the luminaire to pan across the stage.

In some systems, it may be possible that the motor driver 30 is in the control desk rather than in the luminaire 12, and the electrical signals which drive the motor are transmitted via an electrical link directly to the luminaire. It is also possible that the motor driver is integrated into the main processing within the luminaire 12. While many communications linkages are possible, most typically, lighting control desks communicate with the luminaire through a serial data link; most commonly using an industry standard RS485 based serial protocol commonly referred to as DMX-512 (Digital Multiplex 512). Using this protocol, the control desk typically transmits a 16 bit value for pan and a 16 bit value for tilt parameters to the luminaire. Sixteen (16) bits provides for 65,536 values or steps which provides plenty of controller instruction accuracy for a typical application. If the total motion around an axis is 360 degrees, then a 16 bit instruction can provide accuracy of approximately 0.005 degrees (360°/65,536). With this level of accuracy in the control instructional portion of the control system, the limiting factor in controlling the accuracy of the luminaire's motion predominantly lies with the mechanical systems used to move the pan and tilt axes.

Various systems have offered solutions to resonance. One solution is to provide deliberate dampening or friction to the system to smooth and minimize slack and tolerances. In practice, such systems are difficult to control and difficult to manufacture repeatedly and consistently. Additionally, any deliberate addition of friction will of necessity increase the power and size of motors needed and/or slow down the maximum possible movement speed.

Other solutions utilize highly accurate position sensors on the driven or output shaft of the device rather than, as is more common with servo systems, on the motor or driver shaft. Such systems are expensive to manufacture and may require significant processing power for each motor to ensure that smooth accurate movement occurs without hunting or overshoot.

Other system utilize 'hunting' or 'backstepping' techniques, where the system homes in on the final desired position by taking small controlled steps towards it while monitoring the position accurately. Such a system is disclosed in U.S. Pat. No. 5,227,931 to Misumi, which covers an anti-hysteresis system by backstepping. This system is slow to operate, requires an accurate sensor on the driven shaft and produces motion in the driven shaft while the final position is sought. It is important in theatrical applications that the driven shaft moves rapidly and accurately to its final position with no visible oscillation or hunting to find its resting point. Any such motion would be noticeable and distracting to the audience.

A yet further solution is to oscillate the output shaft about its final position to equalize any stress, slack or tolerance in the drive system and center the shaft. U.S. Pat. No. 5,764,018 to Liepe et al. uses a 'shaking' system where reducing oscillations center the driven shaft. This methodology has the disadvantage in that it gives significant and noticeable movement in the output not appropriate for the entertainment lighting application.

While the Misumi and Liepe systems may eventually and consistently get to the right position, the process of getting there may be worse than the resonance and hysteresis problems they solve in an automated luminaire application.

U.S. Pat. No. 6,580,244 to Tanaka et al discloses using two servo motors driven antagonistically to ensure tension is always in the same direction in the drive chain to avoid backlash. Although this provides good control of backlash when the system is always rotating in one direction to its final position, it doesn't cope as well with a system which has no prior knowledge of that direction and that can be required to travel to the same target position from either direction interchangeably. Accurate servos with sensors or encoders are still required for final positioning.

There is a need for a system which can provide resonance control to ensure accurate positioning of an automated luminaire motion control system without the necessity for accurate position sensors.

BRIEF DESCRIPTION OF THE DRAWINGS

For a more complete understanding of the present invention and the advantages thereof, reference is now made to the following description taken in conjunction with the accompanying drawings in which like reference numerals indicate like features and wherein.

DETAILED DESCRIPTION OF THE INVENTION

Preferred embodiments of the present invention are illustrated in the figures, like numerals being used to refer to like and corresponding parts of the various drawings.

The present invention generally relates to motor control systems and specifically to the use of a predictive resonance prevention system to move an output shaft in an automated luminaire. The system disclosed provides smooth movement and negates or cancels out resonances producing bounce or overshoot in the final positioning of the output shaft and can also correct for vibrations and resonances induced into the automated luminaire from external sources.

Figure 1:
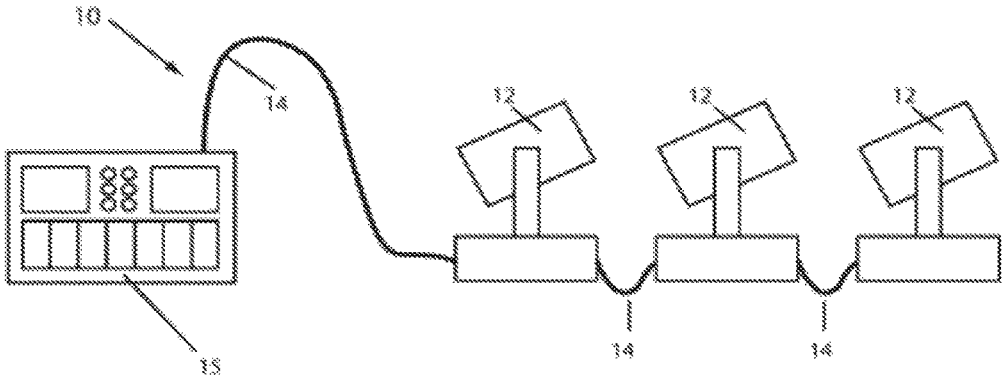
FIG. 1 illustrates a multiparameter automated luminaire lighting system which employs the dampening system.
Figure 2:
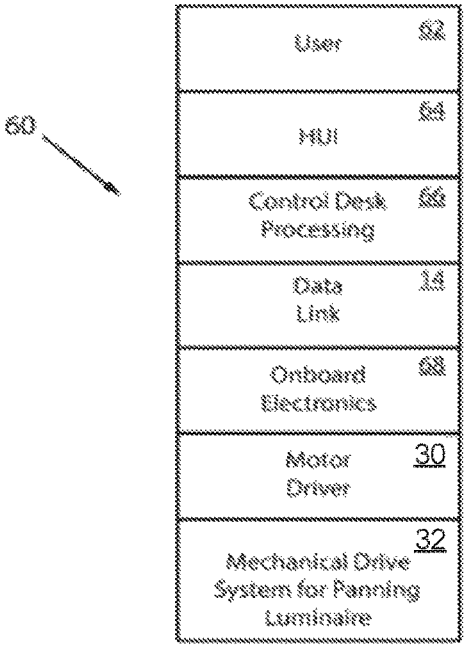
FIG. 2 illustrates an embodiment of the levels of control employed in controlling a parameter of an automated luminaire.
Figure 3:
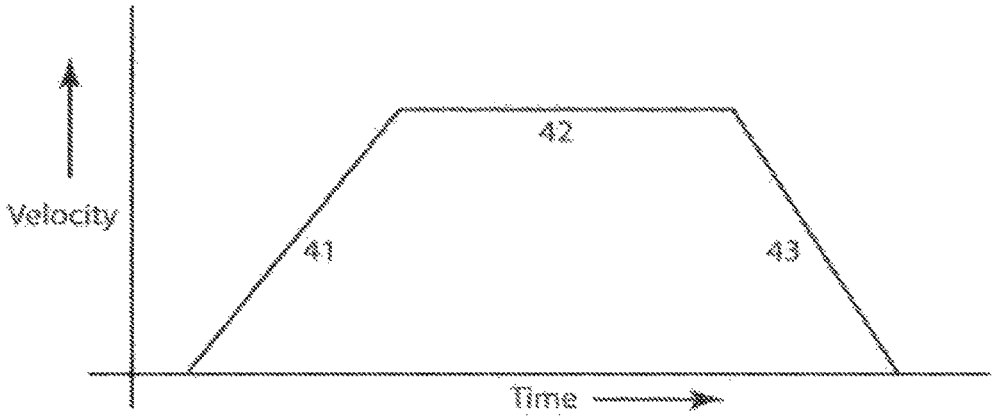
FIG 3 PRIOR ART
FIG. 3 illustrates the movement velocity timing diagram of a prior art automated luminaire.

FIG. 3 illustrates the movement velocity timing diagram of a typical prior art automated luminaire. The vertical axis is velocity of movement, while the horizontal axis represents time. The movement starts from zero velocity with a constant acceleration period 41 leading to a fixed movement velocity 42 with zero acceleration. At the end of the move, the motor enters a constant deceleration phase 43 before coming to a stop. One problem with such a profile is that there are large changes in acceleration at the sharp 'knees' of this profile as movement starts and changes from zero acceleration to a constant acceleration with increasing velocity, changes from constant acceleration with increasing velocity to zero acceleration and constant velocity, changes from zero acceleration to constant deceleration and decreasing velocity, and finally changes to zero deceleration again. These changes in acceleration (variously referred to as rate of change of acceleration, third order movement, $d^3x/dy^3$ or 'jerk') induce resonances in the mechanical system, causing the motor to oscillate, or bounce, when it comes to a rest.

Figure 4:
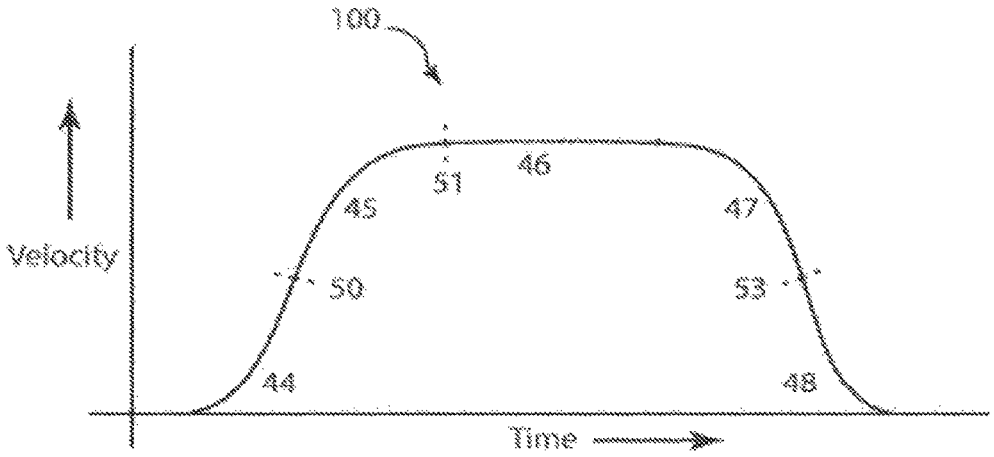
FIG. 4 illustrates the movement velocity timing diagram of an embodiment of the invention.

The invention addresses this problem in two ways. Firstly, as shown in FIG. 4, which is a movement velocity diagram 100 of an embodiment of the invention, the sharp 'knees' where acceleration abruptly changes are replaced by a more gradual change from one acceleration level to another. Movement again starts from rest, then enters a phase of gradually increasing acceleration 44 before reaching constant acceleration through point 50. This is reversed through 45 and acceleration is reduced to zero again by point 51 when constant velocity motion 46 is underway. Bringing the motor to a halt follows a similar procedure, gradually increasing deceleration 47, constant deceleration 53, and gradually decreasing deceleration 48 to the final rest position. Such motion significantly reduces the third order 'jerk' or $d^3x/dy^3$ forces on the motor axis and thus reduces induced resonances. Such resonances are particularly noticeable when the motor is brought to a halt, as they result in the luminaire bouncing or oscillating about its final position.

Figure 5:
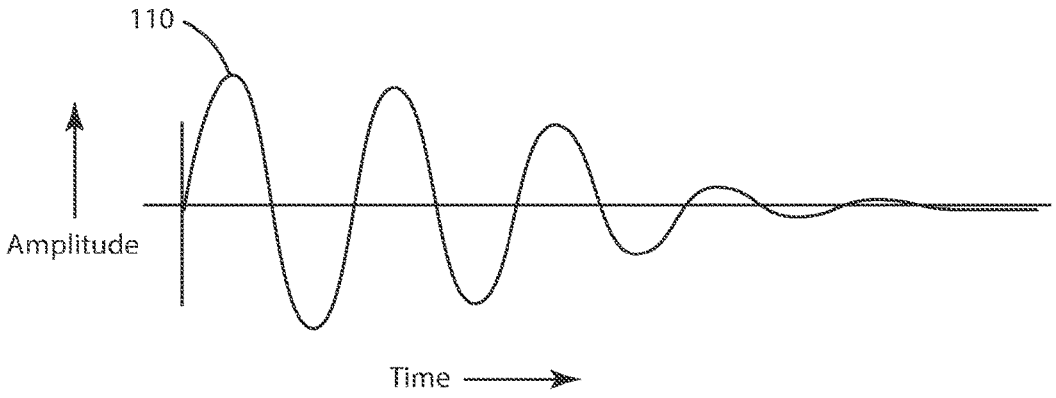
FIG. 5 illustrates resonances of a typical motor system in an automated luminaire.

However, this technique doesn't remove all resonance, as the motion itself and the momentum of the moving mass will excite some resonance in the movement. FIG. 5 illustrates resonances of a typical motor system in an automated luminaire. The frequency of this resonance 110 will vary from unit to unit in manufacturing, depending on material stiffness, mass and so on, but will remain essentially constant for that axis throughout its life. FIG. 5 shows conventional resonance as well known in the art with very little dampening. It is, of course, possible to add mechanical dampening to prevent this kind of resonance and, indeed, many prior art products use this technique. However, such dampening also provides resistance to movement and also slows down the possible maximum speed of a motion of the axis. An embodiment employed instead predicts and induces deliberate forces counter to this resonance so as to cancel it out and dampen motion without slowing down movement speed. This is achieved by first measuring and storing the resonance and motion characteristics shown in FIG. 5 within the onboard electronics 68 of the automated luminaire. The electronics, knowing the resonance curve and also knowing the desired movement from the instructions received through data link 14 from control desk 15, can predict the resonance curve that that motion will produce, and calculate the opposing forces needed to counter it. In some embodiments the measurement of the resonance and motion characteristics may be done in quality control, during design of the product, or during a test procedure before the product is shipped. These complex measurements may further be modeled and simplified by off-line software in order to produce a simpler, possibly parameterized, software model for storage in the onboard electronics 68 of the automated luminaire. This simplified model of the mechanical system and its resonances is suitable for real-time or near real-time processing within onboard electronics 68 which may be less computationally powerful than the off-line system used to create the model.

Figure 6:
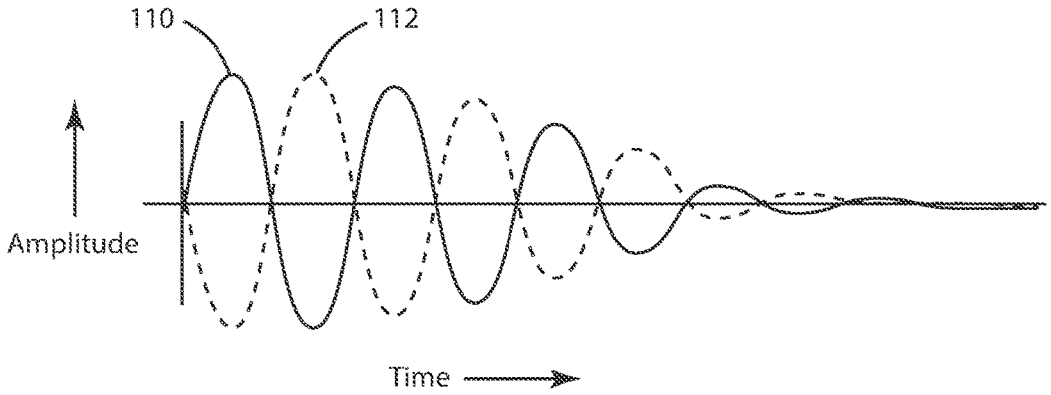
FIG. 6 illustrates the desired opposing forces needed to oppose resonances of a typical motor system in an automated luminaire.

FIG. 6 illustrates the desired opposing forces 112 needed to oppose resonances 110 of a typical motor system in an automated luminaire. The dampening system counters these resonance forces by dynamically adjusting the shape and time of the change of acceleration portions 44, 45, 47, and 48 of the motion time instruction profile. This allows the system to introduce deliberate rate of change of acceleration, (third order 'jerk' or $d^3x/dy^3$) forces on the motor axis and thus induce motion in direct opposition to the resonances and cancel those resonances out.

Figure 7:
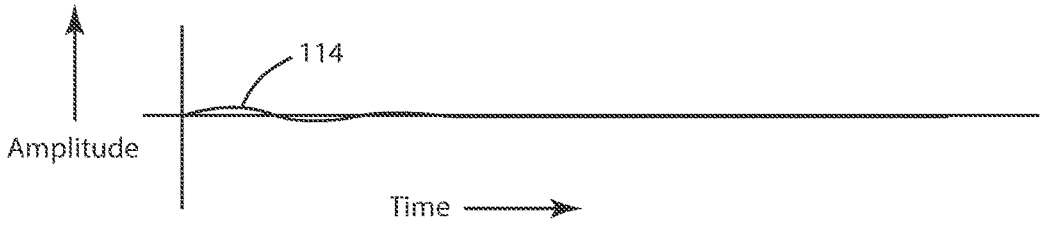
FIG. 7 illustrates the resultant resonances with the dampening system described herein.

The calculations needed to predict this motion and generate the appropriate jerk motion in the movement are done dynamically and continuously based on the current motion of the motor axis, its position, velocity, and acceleration, as well as incoming instructions from control desk 15, in such a manner so as not to alter the final position of the motor axis, and thus the automated luminaire. With the system of the invention in operation, resonance may be reduced to a very low level such as illustrated in curve 114 in FIG. 7, which illustrates the resultant resonances with the dampening system described herein. This results in a rapid and controlled positioning of the motor axis, and thus the automated luminaire, to its desired position with high accuracy and minimal bouncing or overshoot. The critical final positioning, when the motor axis comes to a halt, is virtually free of any bouncing or oscillation and the automated light may be moved at high speeds then brought to an accurate and final stop.

The dynamic correction of resonance in this manner using control of the rate of change of acceleration may be carried out at rates comparable to that of the incoming control signal over a DMX-512 link. In further embodiments of the invention higher update rates comparable to that of the stepper motor update rate, perhaps 100 microseconds, may be used. This allows the correction and resonance cancellation to occur effectively in real-time, with the system tracking and following any changes to the incoming control signal over a DMX-512 link.

A further advantage of the invention is that no new hardware is required and it may be possible, if the control electronics are powerful enough, to retrofit the appropriate software to existing units without any physical modification.

In some embodiments of the invention, the resonance characteristics of the motion of the motor axes of an automated light may be measured during manufacture and stored within the luminaire.

In further embodiments of the invention, the resonance characteristics of the motion of the motor axes of an automated light may be measured using feedback sensors on the luminaire during operation, including but not limited to accelerometers, gyros, and optical encoders.

In further embodiments of the invention, the movement and resonance characteristics of the motion of the motor axes of an automated light may be measured using feedback sensors on the luminaire during operation and the counter resonance jerk applied in a closed loop manner using continuous feedback from those sensors.

Figure 8:
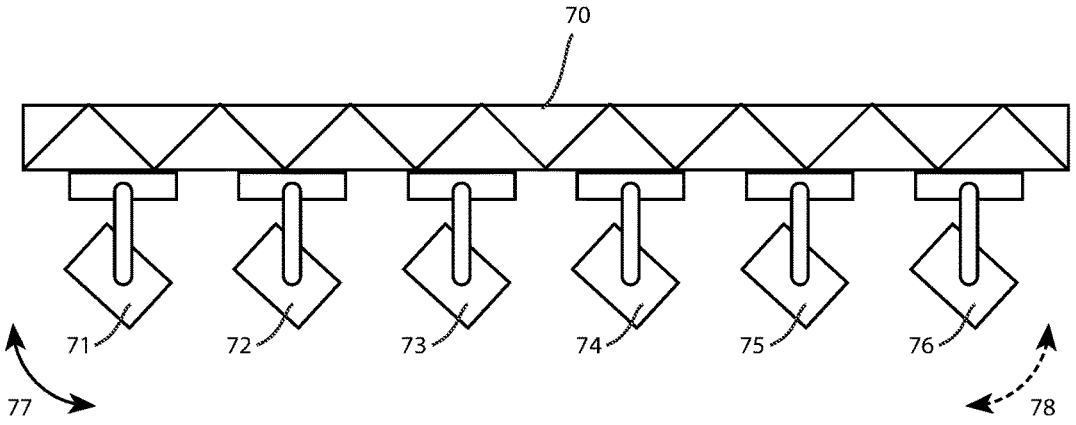
FIG. 8 illustrates a typical installation of an embodiment of the invention where vibration is a problem.

FIG. 8 illustrates a typical installation of automated luminaires where vibration is a problem. Automated luminaires 71-76 are installed on a common support member 70. Support member 70 may be a lighting truss or lighting bar or other similar mechanical support. All the automated lights are initially stationary and then one luminaire, 71, is moved, as shown by arrow 77. The movement 77 of luminaire 71 will cause movement and vibration in support member 70 which will be transmitted to other luminaire mounted to the same support member. For example, automated luminaire 76 will be influenced by these movements resulting in a sympathetic vibration or movement 78 that, in tum, results in undesirable movement of the output light beam from luminaire 76. In an embodiment of the invention, automated luminaire 76 may be fitted with a motion feedback sensor of a type including but not limited to accelerometers and gyros or other type of sensor capable of detecting motion. This feedback sensor will detect the sympathetic vibration induced in luminaire 76 from support member 70 and, through the prediction and modeling system described herein, apply contrary motion and impulses to the pan and tilt movement motors of automated luminaire 76 such that the induced movement is rapidly and substantially dampened and movement in the output light beam is mitigated.

The system described will prevent or substantially mitigate objectionable movement of the output light beam when the luminaire 76 is subject to any kind of external vibration or movement. This external movement could come, as shown here, from the movement of other automated luminaire on the same or connected support member, or could come from other devices such as fans, moving scenery, loudspeakers, or any other vibration source.

While the disclosure has been described with respect to a limited number of embodiments, those skilled in the art, having benefit of this disclosure, will appreciate that other embodiments may be devised which do not depart from the scope of the disclosure as disclosed herein. The disclosure has been described in detail, it should be understood that various changes, substitutions and alterations can be made hereto without departing from the spirit and scope of the disclosure.

What is claimed is:

1. A motor control system, comprising:

a motor driver, configured to cause changes in a physical position of an automated luminaire;

a motion sensor mechanically coupled to the drive system and configured to detect changes in the physical position of the automated luminaire; and a processor, electrically coupled to the motion sensor and the motor driver and configured to:

determine changes in acceleration of the automated luminaire;

determine resonance-induced changes in the physical position of the automated luminaire; and create drive signals for the motor driver to counter the determined resonance-induced changes in the physical position of the automated luminaire based on premeasured resonance characteristics of the automated luminaire that are stored in a memory of the automated luminaire.

2. The motor control system of claim 1, wherein the resonance characteristics of the automated luminaire are stored in the memory of the automated luminaire by a manufacturer of the automated luminaire.

3. The motor control system of claim 1, wherein the resonance characteristics of the automated luminaire comprise a parameterized software model.

4. The motor control system of claim 1, wherein the processor is further configured to determine changes in acceleration of the automated luminaire by one of (i) receiving a measurement of acceleration from an accelerometer mounted in the automated luminaire or (ii) calculating a third order derivative of the determined changes in position of the automated luminaire.

5. The motor control system of claim 1, wherein the processor is further configured to:

determine externally induced changes in the physical position of the automated luminaire; and create drive signals for the motor driver based on the externally induced changes in the physical position of the automated luminaire while creating drive signals for the motor driver to counter the determined resonance-induced changes in the physical position of the automated luminaire.

6. The motor control system of claim 1, wherein the processor is configured to create drive signals for the motor driver to counter the determined resonance-induced changes in the physical position of the automated luminaire further based on position control signals received via a DMX-512 link.

7. An automated luminaire, comprising:

a motor configured to rotate an automated luminaire about an axis of rotation;

a sensor mechanically coupled to the automated luminaire and configured to detect the rotation of the automated luminaire;

a memory; and a control circuit electrically coupled to the motor, the sensor, and the memory, the control circuit configured to:

determine changes in acceleration of the automated luminaire about the axis of rotation;

determine resonance-induced changes in the rotation of the automated luminaire; and create drive signals for the motor to counter the determined resonance-induced changes in the rotation of the automated luminaire based on premeasured resonance characteristics of the automated luminaire stored in the memory.

8. The automated luminaire of claim 7, wherein the resonance characteristics of the automated luminaire are stored in the memory by a manufacturer of the automated luminaire.

9. The automated luminaire of claim 7, wherein the resonance characteristics of the automated luminaire comprise a parameterized software model.

10. The automated luminaire of claim 7, further comprising an accelerometer mechanically coupled to the automated luminaire and electrically coupled to the control circuit, wherein the control circuit is configured to determine changes in acceleration of the automated luminaire using the accelerometer.

11. The automated luminaire of claim 7, wherein the control circuit is further configured to:

determine externally induced changes in the rotation of the automated luminaire using the sensor; and create drive signals for the motor additionally based on the externally induced changes in the rotation of the automated luminaire.

12. The automated luminaire of claim 7, wherein the processor is further configured to:

receive position control signals via a DMX-512 link; and create the drive signals for the motor to counter the determined resonance-induced changes in the rotation of the automated luminaire further based on the received position control signals.

13. A method for countering resonance in an automated luminaire, comprising:

detecting rotation of an automated luminaire about an axis of rotation;

determining changes in an acceleration of the automated luminaire about the axis of rotation;

determining resonance-induced changes in the rotation of the automated luminaire; and countering the determined resonance-induced changes in the rotation of the automated luminaire by creating drive signals for a motor configured to rotate the automated luminaire about the axis of rotation, the drive signals based on premeasured resonance characteristics of the automated luminaire that are stored in a memory of the automated luminaire.

14. The method of claim 13, wherein the resonance characteristics of the automated luminaire are stored in the memory by a manufacturer of the automated luminaire.

15. The method of claim 13, wherein the resonance characteristics of the automated luminaire comprise a parameterized software model.

16. The method of claim 13, wherein the changes in the acceleration of the automated luminaire about the axis of rotation are determined using an accelerometer.

17. The method of claim 13, wherein the changes in the acceleration of the automated luminaire about the axis of rotation are determined by calculating a third order derivative of the detected rotation of the automated luminaire.

18. The method of claim 13, further comprising determining externally induced changes in the rotation of the automated luminaire, wherein creating drive signals for a motor configured to rotate the automated luminaire about the axis of rotation is further based on the determined externally induced changes in the rotation of the automated luminaire.

19. The method of claim 13, further comprising receiving position control signals via a DMX-512 link, wherein creating drive signals for a motor configured to rotate the automated luminaire about the axis of rotation is further based on the received position control signals.

* * * * *